US010288297B2

(12) United States Patent
Gutierrez et al.

(10) Patent No.: US 10,288,297 B2
(45) **Date of Patent: *May 14, 2019**

(54) MOVABLE COOKING APPLIANCE

(71) Applicant: Whirlpool Corporation, Benton Harbor, MI (US)

(72) Inventors: Diego Neftali Gutierrez, Varese (IT); Gianpiero Santacatterina, Cittiglio (IT); Francesco Farachi, Inarzo (IT)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/058,023

(22) Filed: Aug. 8, 2018

(65) Prior Publication Data

US 2018/0347825 A1 Dec. 6, 2018

Related U.S. Application Data

(63) Continuation of application No. 15/874,320, filed on Jan. 18, 2018, now Pat. No. 10,054,316, which is a continuation of application No. 13/079,040, filed on Apr. 4, 2011, now Pat. No. 9,879,864.

(30) Foreign Application Priority Data

Apr. 9, 2010 (EP) ..... 10159550

(51) Int. Cl.
*F24C 15/16* (2006.01)
*H01R 13/703* (2006.01)

(52) U.S. Cl.
CPC ..... *F24C 15/166* (2013.01); *F24C 15/16* (2013.01); *H01R 13/7032* (2013.01); *H01R 13/7037* (2013.01)

(58) Field of Classification Search
CPC ..... H01R 13/00; H01R 13/005; G02B 6/3807
USPC ..... 219/386, 387, 521, 601, 620, 621
See application file for complete search history.

(56) References Cited

U.S. PATENT DOCUMENTS

| | | | | |
|---|---|---|---|---|
| 3,740,513 A | | 6/1973 | Peters, Jr. et al. | |
| 4,308,443 A | | 12/1981 | Tucker et al. | |
| 4,797,774 A | * | 1/1989 | Clayton | G01D 3/021 361/86 |
| 4,910,372 A | | 3/1990 | Vukich | |

(Continued)

FOREIGN PATENT DOCUMENTS

| | | |
|---|---|---|
| CN | 201318717 | 9/2009 |
| DE | 10031167 | 1/2002 |

(Continued)

*Primary Examiner* — Phuong T Nguyen
(74) *Attorney, Agent, or Firm* — Diederiks & Whitelaw, PLC

(57) ABSTRACT

A movable cooking appliance comprises a structure which is adapted to be placed on a kitchen worktop appliance or inside a cooking oven appliance and includes a heating element and releasable connector assembly for making electrical connection with power supply connectors. The heating element is an induction heating element and an electronic driving unit is mounted on the appliance. The releasable connector assembly comprising a plug connector having a plurality of terminals designed in order to provide a disconnection signal to the electronic unit before the power supply connectors are fully extracted.

20 Claims, 6 Drawing Sheets

(56) References Cited

U.S. PATENT DOCUMENTS

| | | | | |
|---|---|---|---|---|
| 5,272,317 | A | 12/1993 | Ryu | |
| 5,648,008 | A | 7/1997 | Barritt et al. | |
| 2005/0006373 | A1 * | 1/2005 | Owens ..... | A47J 36/2483<br>219/387 |

FOREIGN PATENT DOCUMENTS

| | | |
|---|---|---|
| DE | 102005029769 | 1/2007 |
| GB | 2209892 | 5/1989 |
| JP | 2004079401 | 3/2004 |
| WO | 00/11758 | 3/2000 |

* cited by examiner

MOVABLE COOKING APPLIANCE

CROSS-REFERENCE TO RELATED APPLICATION

This application represents a continuation application of U.S. application Ser. No. 15/874,320 titled "Movable Cooking Appliance" and filed on Jan. 18, 2018, pending, which represents a continuation of U.S. application Ser. No. 13/079,040, titled "Movable Cooking Appliance" and filed on Apr. 4, 2011, now U.S. Pat. No. 9,879,864. The entire content of these application is incorporated herein by reference.

BACKGROUND OF THE INVENTION

Field of the Invention

The present invention relates to movable cooking appliances or cooking trays including structure which is adapted to be placed on a worktop of kitchen furniture or inside a cooking oven (collectively referred to as a cooking unit), and includes a heating element and releasable connector means for making electrical connection with power supply connector means. With the term "movable" we mean any kind of cooking and heating appliance which can be plugged or unplugged to a fixed support, whatever such support is.

Description of the Related Art

The above kind of cooking appliances or cooking accessories are well known in the art. An example is shown in U.S. Pat. No. 5,272,317. With the known appliances the heating element is an electrical resistance heater connected, for instance, to a shelf or tray adapted to be introduced into an oven cavity. The use of electrical resistance heaters has been replaced by more efficient induction heating elements which, despite a higher complexity and cost (mainly due to the complex electronic driving circuit), allow the induction heating elements to reach a desired temperature in a shorter time and with a lower energy consumption. One compromise would be to design an induction cooking appliance or accessory without a built-in electronic driving circuit, and integrating this in kitchen furniture or cooking appliance (such as a traditional oven or an induction oven). By adopting this solution it is important to assure a safe and reliable connection between the "fixed" electronic driving circuit and the movable induction cooking appliance or accessory.

Prior art connectors that are in use generally have terminals with equal length. The design of these connectors doesn't implement any further safety feature that guarantees power supply cut-off when the user is extracting the removable tray with an induction heater while the tray is working. This abnormal procedure may happen during the use of the oven and this can cause a potential risk of electric arcing at the power terminals and potential breakdown of the insulated gate bipolar transistor (IGBT) associated with the electronic driving circuit of the heating element.

SUMMARY OF THE INVENTION

The present invention is mainly focused on the problem of assuring safe and reliable insertion and extraction of a releasable connector means for connecting an induction tray, for instance, into an oven cavity. The present invention also addresses a tray including an induction element being plugged into or unplugged from the socket of a power supply connector means located inside an oven cavity in a safe manner. It is therefore an object of the present invention to provide a solution to the above concerns.

The present invention is focused on the design of a connector that is to be used to connect an induction tray into a socket of an oven cavity or other type of support used for the tray. In a preferred embodiment of the invention, the connector has five male terminals, including two for the power connection (i.e., supplying an induction heating coil), two for the temperature sensor connection (that allows a reading of temperature sensor placed in the coil centre of the induction heating element for safety reasons) and one a ground connection (that guarantees electrical safety for the user). The design of the connector according to the invention enables a safer and more reliable insertion and extraction of the male plug of the induction heating tray whenever the user uses it as an accessory inside an oven or on a kitchen worktop.

BRIEF DESCRIPTION OF THE DRAWINGS

Further advantages and features according to the present invention will be clear from the following detailed description, with reference to the attached drawings in which.

DETAILED DESCRIPTION OF PREFERRED EMBODIMENTS

Figure 1:
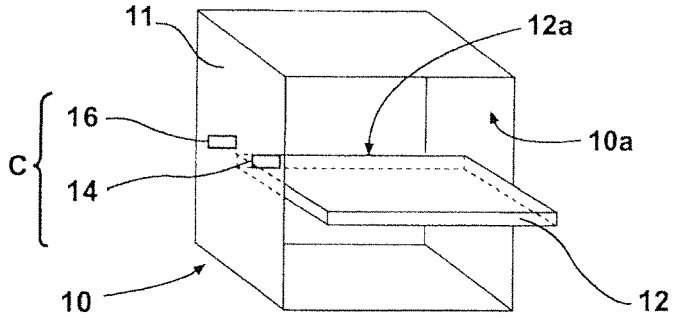
FIG. 1 is a schematic view of an oven according to the present invention.

With reference to the drawings, an induction oven having a cabinet 10 is shown in FIG. 1, the oven cabinet 10 defining a cooking cavity 10*a* where an induction tray 12 can be inserted and pulled out. The tray 12 has a double layer main body structure made of non-ferromagnetic material, such as aluminium, and includes an embedded induction heating element or coil (indicated at 36 in FIGS. 11 and 12) with a temperature sensor (depicted at 34 in FIG. 11). On a rear side 12*a* of the tray 12 there is a plug connector 14 for the electrical connection of tray 12 with a socket connector 16 placed on a rear wall 11 of the oven cavity 10*a*. In the following, we indicate with reference C the overall power connector assembly of the present invention, including the plug or male connector 14 supported by the tray 12 and the socket or female connector 16 supported by the oven.

As noted previously, with known connectors, the design is not able to provide good safety as it doesn't implement any extra feature which lets the power board cut off the power before male plug extraction. Because of this, extraction of the induction tray 12 without cutting off the power supply to tray 12 may cause safety problems for the customer and reliability problems for the oven.

Figure 2:
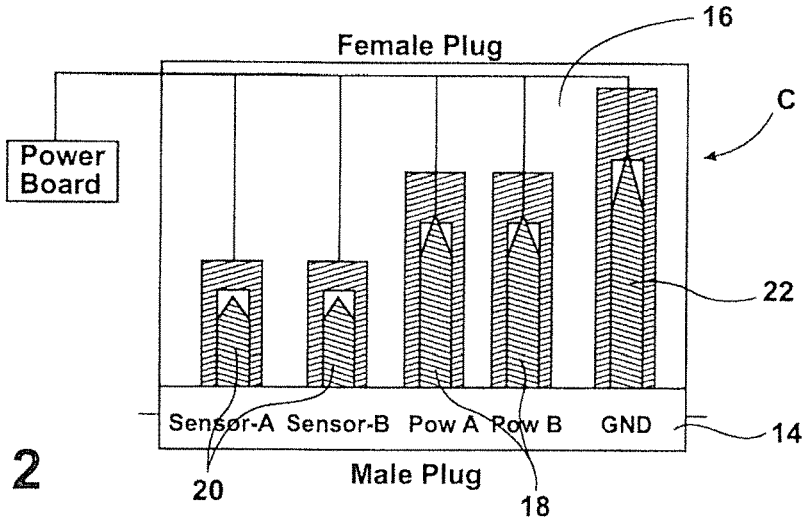
FIG. 2 is a schematic view detailing the male and female terminals of a plug connector of the oven of FIG. 1, according to a first embodiment of the invention and in a first configuration of use.
Figure 3:
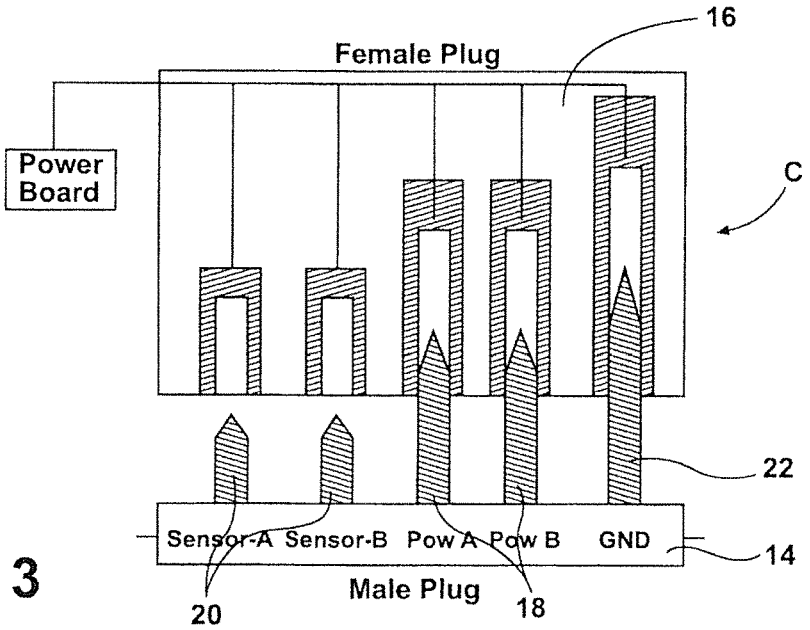
FIG. 3 is a schematic view similar to FIG. 2, showing the terminals in a second configuration of use.
Figure 4:
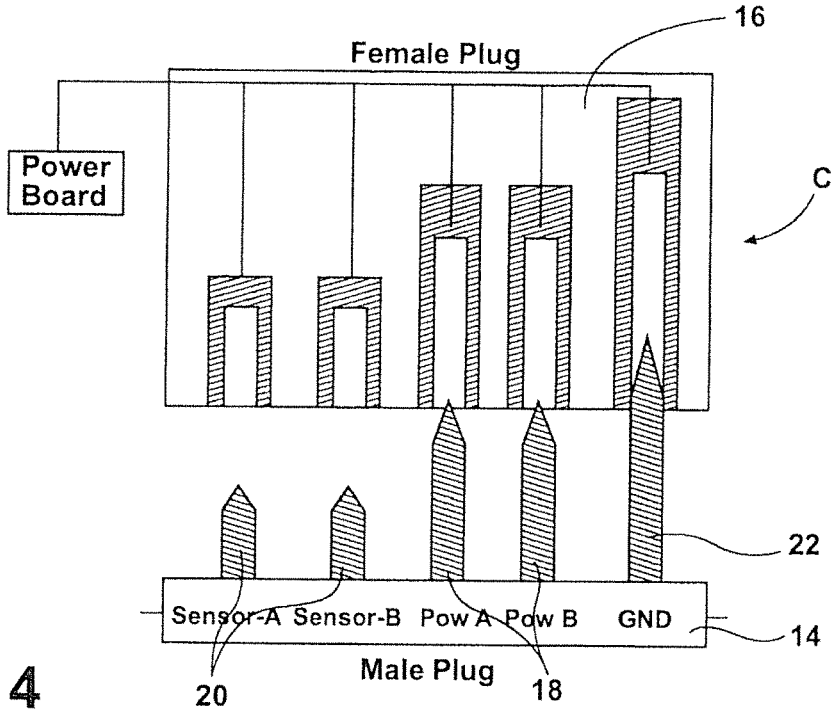
FIG. 4 is a schematic view similar to FIG. 2, showing the terminals in a third configuration.
Figure 5:
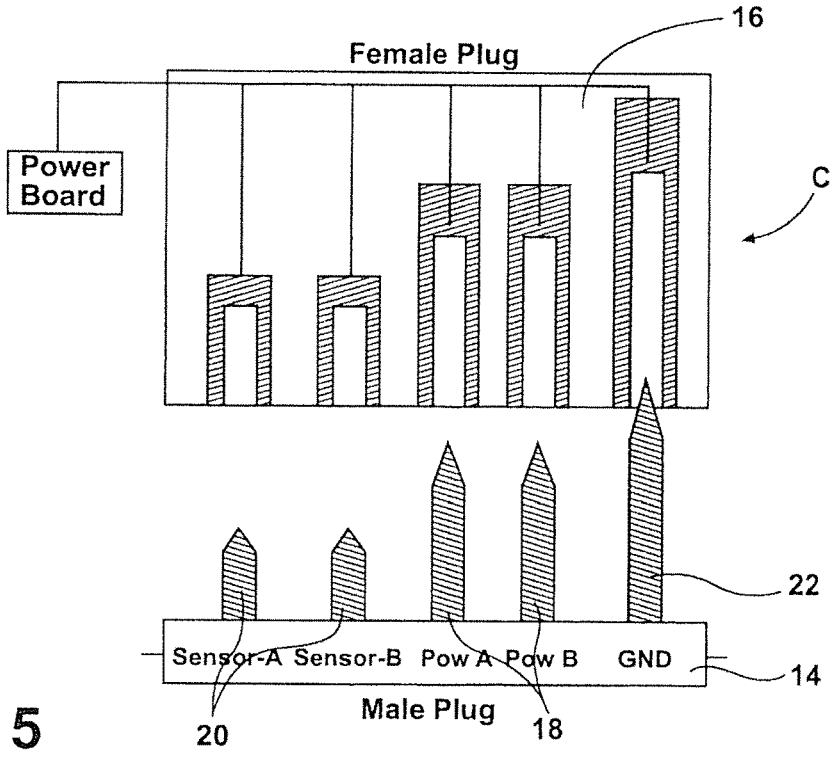
FIG. 5 is a schematic view similar to FIG. 2, showing the terminals in a fourth configuration.

According to a first embodiment of the present invention depicted in FIG. 1, the design of connector C presents assemblies of five male terminals and associated female terminals which make up a total of five connections. Two sets of the terminals 18 provide power connections, two sets of the terminals 20 are for the temperature sensor connection and one set including terminal 22 is for the ground connection. As shown in the embodiment of FIG. 2, the ground terminal 22 has the greatest length, the sensor terminals 20 (equal to each other in length) are the shortest ones and the power terminals 18 (equal to each other in length) have an intermediate length between the lengths of the ground terminal 22 and of the sensor terminals 20. This design enables the ground terminal 22 to connect first during insertion of plug 14, and to disconnect last during extraction of the plug 14, guaranteeing safety electrical discharge through ground terminal 22 in case there might be a discharge between induction coil 36 (again depicted in FIGS. 11 and 12) and aluminium plates of the tray 12, thus eliminating the electrical risks for the user. FIGS. 2, 3, 4 and 5 show different positions of the male-female connector C: FIG. 2 shows a complete insertion of the plug 14 with all terminals having complete electrical contact; FIG. 3 shows a partial extraction of male plug 14 with ground 22 and power terminals 18 yet in contact; FIG. 4 shows a configuration in which only ground 22 remains in contact; and FIG. 5 shows full extraction, i.e., all terminals are not in contact with socket connector 16. As illustrated in FIG. 3, during extraction of the male plug 14, the sensor terminals 20 lose electrical contact first since they have the shortest length. Once this happens, a power board indicated at P senses the connection as an open-circuit and automatically cuts off the power to the tray 12 before the power terminals are actually disconnected (as they are still in contact with the female sockets due to their longer terminals).

Figure 6:
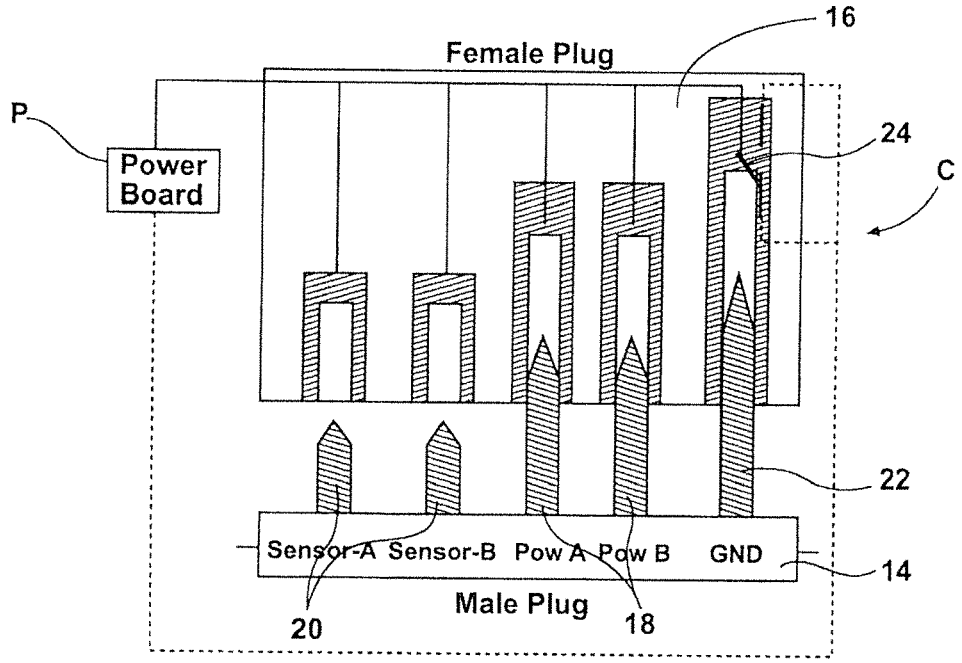
FIG. 6 is a schematic view detailing the male and female terminals of the plug connector an oven of FIG. 1, according to a second embodiment of the invention.
Figure 13:
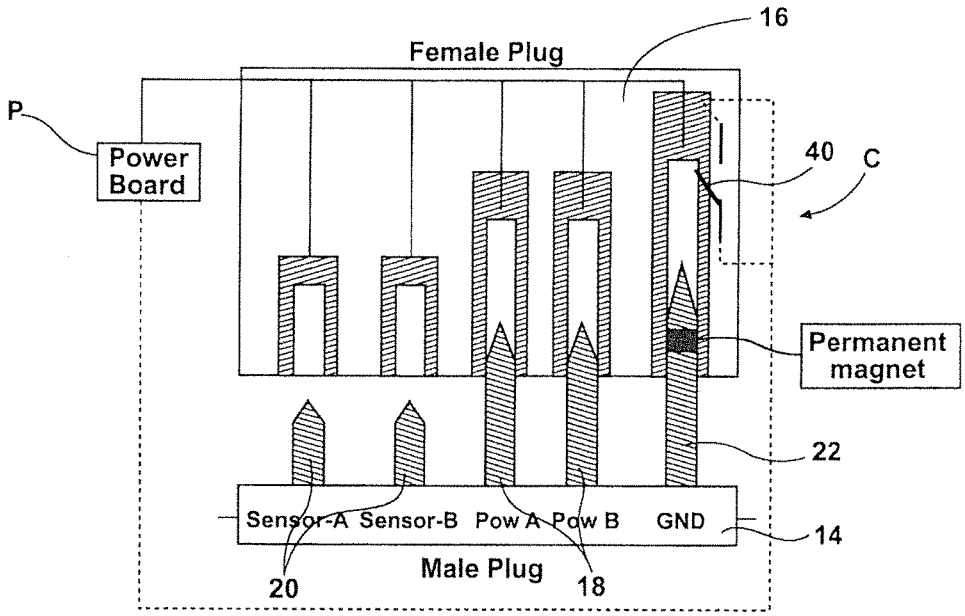
FIG. 13 is a schematic view detailing the male and female terminals of a plug connector of the oven of FIG. 1, according to another embodiment of the invention, in a partially unplugged position.
Figure 14:
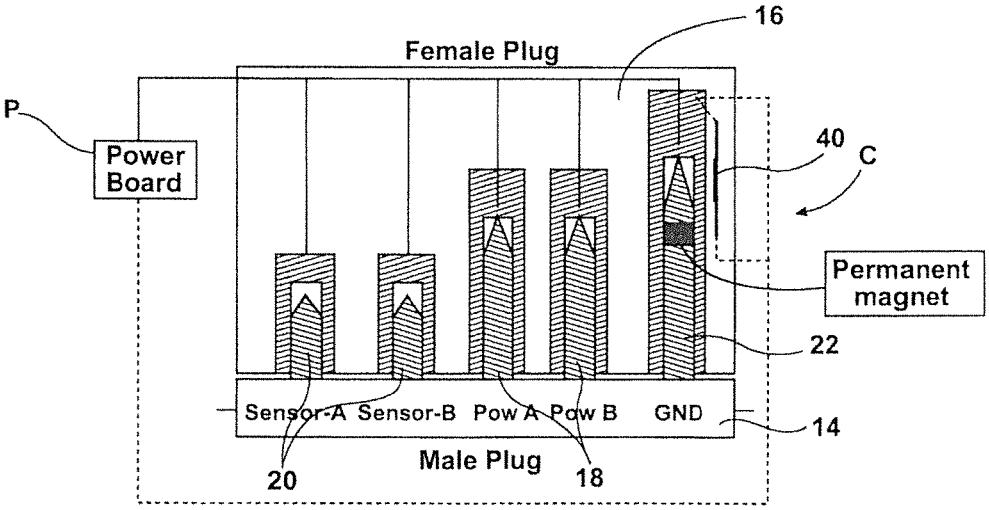
FIG. 14 is a schematic view similar to FIG. 13, in a plugged position.

According to a second embodiment of the invention depicted in FIG. 6, inside the female plug 16 there is a switch 24 that is electrically closed by the ground plug 22 when inserting the male plug 14. This circuit is connected to power board P of the oven. The switch 24 can be of any kind. For instance, it can be a mechanical switch (that is in physical contact with the terminals) or it can be a proximity switch (that doesn't need a physical contact), such as a reed switch 40 shown in FIGS. 13 and 14. This switch mechanism 24 can be short-circuited and open-circuited, distinguishing the cases between complete male plug insertion and not complete insertion, respectively. As can be seen in FIG. 6, the extraction of the male plug 14 from the female socket 16 including mechanical switch 24 causes the opening of the circuit, sending therefore a signal to the power board P to interrupt the power supply to the tray 12 before the power terminals 18 are disconnected.

It is clear that the position of the mechanical switch 24 (in FIG. 6 it is positioned close to the ground terminal 22) can vary and can be applied to any other terminal. However, it must be placed in a way that the mechanical switch 24 opens before the power terminals 18 are completely extracted, in order to allow the power board P to cut off the power before the connector 14 is fully extracted from female plug 16 (safety power cut-off).

Figure 7:
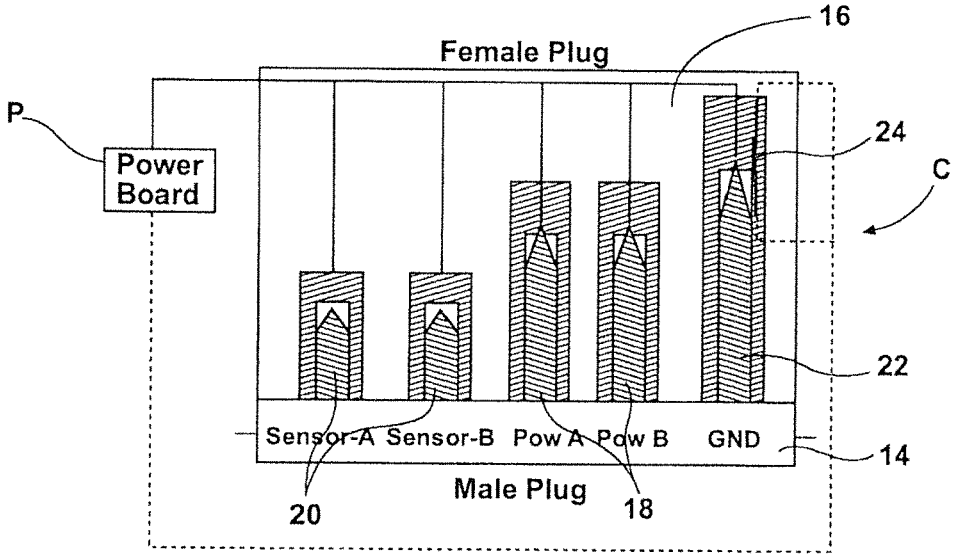
FIG. 7 is a variant of the embodiment shown in FIG. 6.

FIG. 7 shows a connector C which is slightly different from the one shown in FIG. 6, and where the length of the terminals 18, 20 and 22 are similar to the one shown in FIG. 2. In this embodiment, the ground terminal 22 remains the longest for safety precaution as already explained. If the switch 24 is a reed switch, the terminal involved has to be made of permanent magnetic material.

Figure 8:
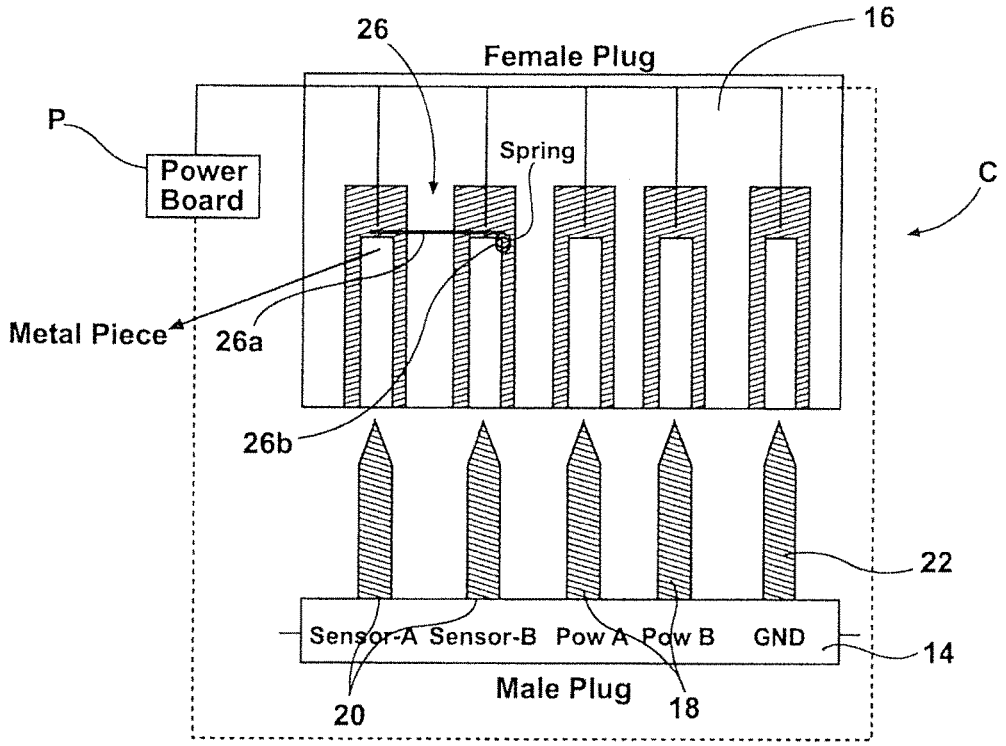
FIG. 8 is a schematic view detailing the male and female terminals of a plug connector of the oven of FIG. 1, according to a third embodiment of the invention and in an unplugged configuration.
Figure 9:
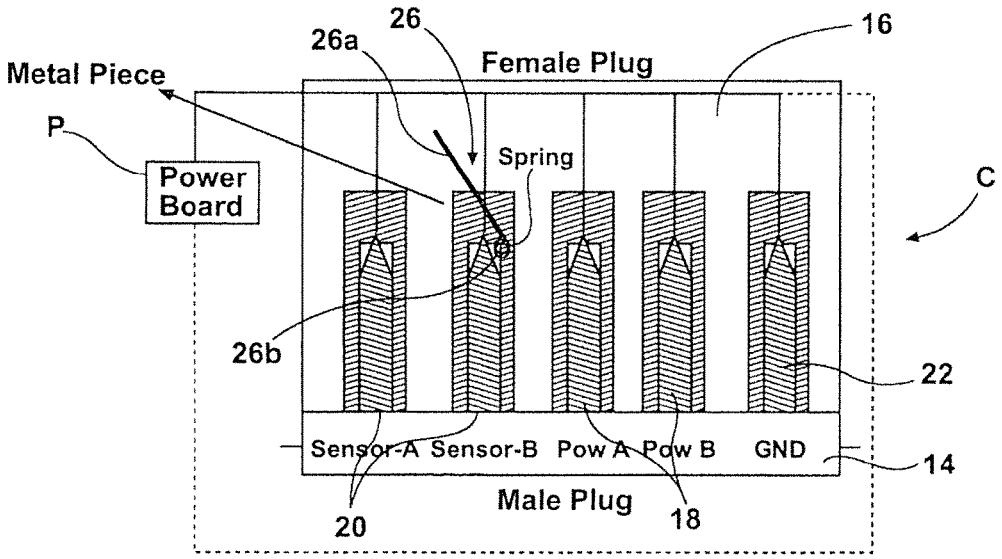
FIG. 9 is a schematic view similar to FIG. 8 in a plugged configuration.

A further embodiment of the present invention is shown in FIGS. 8 and 9, where the male plug 14 has terminals of identical lengths and a female socket 16 with a mechanical switch mechanism 26. This mechanism 26 comprises a metal piece 26*a* hinged to one of the temperature sensor female terminals 20 via a spring 26*b*. When the male plug 14 is not inserted (FIG. 8), the metal piece 26*a* contacts both terminals 20 of sensor 34, short-circuiting them. The power board P senses that temperature sensor terminals 20 are short circuited and it doesn't supply power to induction tray 12. Otherwise, when the male plug 14 is inserted (FIG. 9), the metal piece 26*a* doesn't contact both terminals 20 and therefore the power board P supplies power to the induction tray 12 as it senses that the male plug 14 is fully inserted and there is no safety issue.

Figure 10:
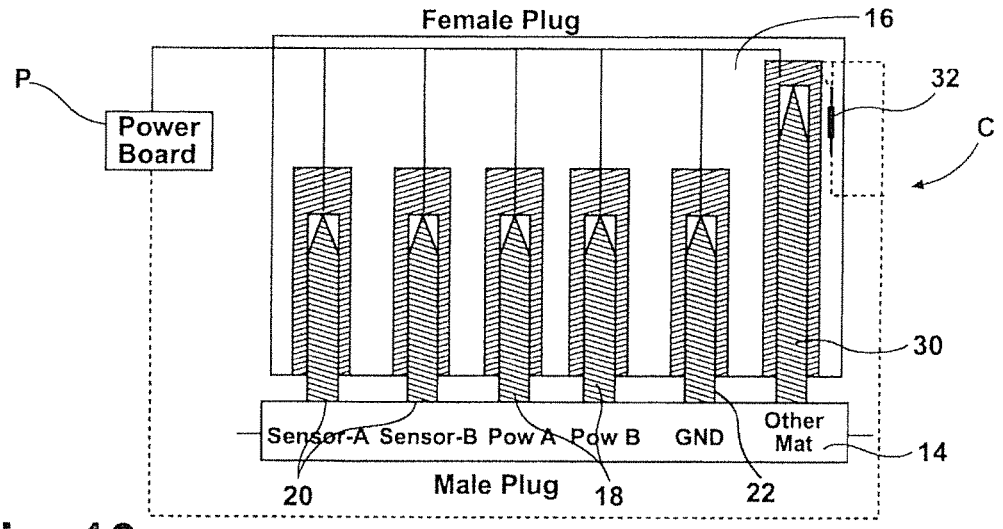
FIG. 10 is a schematic view detailing the male and female terminals of a plug connector according to a fourth embodiment of the present invention.

The embodiment shown in FIG. 10 has all five terminals 18, 20, 22 mentioned above at equal length, and it presents in addition a sixth terminal 30*b* (associated with an additional plug 30*a*) which is made of another material such as ceramic or plastic and which has a greater length than other terminals. This sixth terminal 30*b* turns on and off the electrical connection by a mechanical switch 32 during insertion and extraction, respectively.

Figure 11:
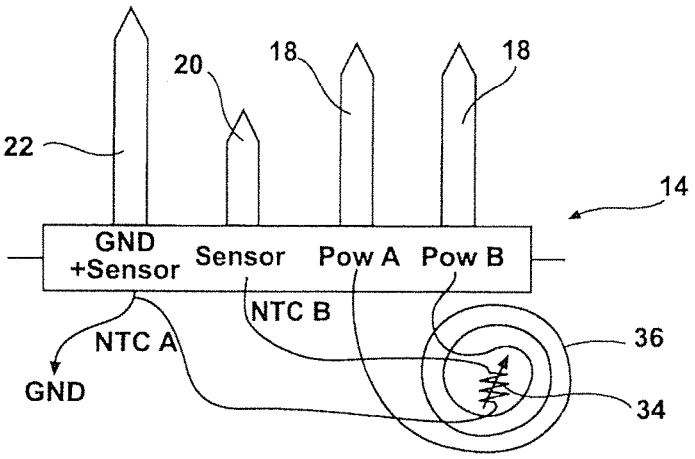
FIG. 11 is a schematic view of the male terminals of a plug connector in accordance with a further embodiment of the present invention.

The embodiment shown in FIG. 11 has the aim of reducing the number of terminals or to avoid the need of adding extra sensor terminals. Reducing the number of terminals would provide a cost saving and easier connection in addition to space saving inside the oven. More specifically, the male plug 14 in this embodiment has four terminals consisting of one ground terminal 22, two power terminals 18 and one single terminal 20 for a temperature sensor indicated with reference 34 in FIG. 11, while the induction coil is schematically indicated with reference 36. According to this embodiment, in order to save material and space, it is possible to use the ground terminal 22 as the second sensor terminal. This embodiment has the ground terminal 22 with the greatest length, the sensor single terminal 20 with the shortest length and the power terminals 18 in between these two lengths as in the first above embodiment. The power board P should be designed for reading the sensor signal with an isolated signal-conditioning circuit, as it is referenced with the oven ground which is isolated with respect to the power supplier in any appliance by default.

Figure 12:
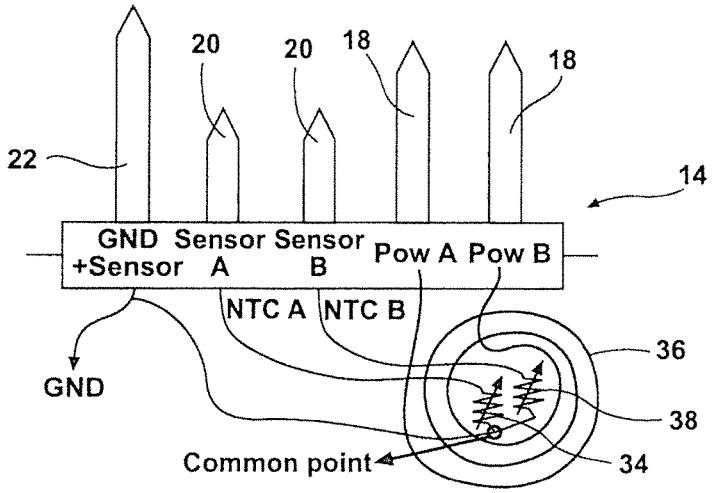
FIG. 12 is a schematic view of the male terminals of a plug connector in accordance with yet a further embodiment of the present invention.

In the further embodiment shown in FIG. 12, the five terminals of the previous embodiment 18, 20 and 22 are maintained and an extra temperature sensor 38 is added that will still use the ground as a reference level. This can also be extended to three readings using three terminals and a ground terminal, and so on. Increasing the number of temperature readings enables a better control of the induction heater temperature, and using the ground terminal provides a savings from the number of terminals needed. The power board P should be designed for reading the sensor signal with an isolated signal-conditioning circuit in this embodiment, as well.

Even if in the above embodiments the plug connector 14 is shown as supported by the induction tray 12, it is clear that such a plug connector can be supported by the rear oven wall 11 and the socket connector 16 can be supported by the tray 12 as well.

The invention claimed is:

1. A cooking appliance comprising:

a cooking unit including an electronic driving unit;

an induction tray including an induction heating element, wherein the induction tray is configured to be removably attached to the cooking unit; and a connector assembly interconnecting the induction tray to the cooking unit to provide power to and control the induction tray, wherein the connector assembly includes:

a female connector assembly including a plurality of female terminals, the female connector assembly being attached to one of the induction tray or the cooking unit; and a male connector assembly including a plurality of male terminals, the male connector assembly being attached to another one of the induction tray or the cooking unit, wherein the plurality of male terminals are configured to be selectively inserted into, or removed from, respective ones of the plurality of female terminals to interconnect the induction tray to a power source, the connector assembly incorporates safety means for causing the power source to be disconnected from the induction tray through the male and female connector assemblies before the plurality of male terminals are fully removed from the plurality of female terminals, at least one male terminal of the plurality of male terminals is a temperature sensor terminal electrically connected to a temperature sensor of the induction heating element, and the safety means comprises the at least one male terminal being configured such that the at least one male terminal is removed from at least one female terminal of the plurality of female terminals to provide a disconnection signal to the electronic driving unit before all of the plurality of male terminals are fully removed from their respective plurality of female terminals.

2. The cooking appliance of claim 1, wherein the at least one male terminal is configured shorter in length than the other ones of the plurality of male terminals such that removing the at least one male terminal from at least one female terminal of the plurality of female terminals provides the disconnection signal to the electronic driving unit before all of the plurality of male terminals are fully removed from their respective plurality of female terminals.

3. The cooking appliance of claim 1, wherein various ones of the plurality of male terminals vary in length so as to be removed from respective ones of the plurality of female terminals at varying times to provide the disconnection signal to the electronic driving unit before all of the plurality of male terminals are fully removed from their respective plurality of female terminals.

4. The cooking appliance of claim 3, wherein the plurality of male terminals includes at least three sets of terminals with distinct lengths so as to be removed from respective ones of the plurality of female terminals at three different times to provide the disconnection signal to the electronic driving unit before all of the plurality of male terminals are fully removed from their respective plurality of female terminals.

5. The cooking appliance of claim 1, wherein another male terminal of the plurality of male terminals and at least one female terminal of the plurality of female terminals are configured to establish a ground connection for a sensor circuit, the sensor circuit including the temperature sensor of the induction heating element.

6. The cooking appliance of claim 1, wherein the plurality of male terminals includes first and second sensor terminals, first and second power terminals and a ground terminal.

7. The cooking appliance of claim 6, wherein the first and second sensor terminals are configured shorter in length than the first and second power terminals, and the first and second power terminals are shorter in length than the ground terminal.

8. A cooking appliance comprising:

a cooking unit including an electronic driving unit;

an induction tray including an induction heating element, wherein the induction tray is configured to be removably attached to the cooking unit; and a connector assembly interconnecting the induction tray to the cooking unit to provide power to and control the induction tray, wherein the connector assembly includes:

a female connector assembly including a plurality of female terminals, the female connector assembly being attached to one of the induction tray or the cooking unit; and a male connector assembly including a plurality of male terminals, the male connector assembly being attached to another one of the induction tray or the cooking unit, wherein the plurality of male terminals are configured to be selectively inserted into, or removed from, respective ones of the plurality of female terminals to interconnect the induction tray to a power source, the connector assembly incorporates safety means for causing the power source to be disconnected from the induction tray through the male and female connector assemblies before the plurality of male terminals are fully removed from the plurality of female terminals, and the safety means comprises a switch acted upon by one of the plurality of male terminals to provide a disconnection signal to the electronic driving unit before all of the plurality of male terminals are fully removed from their respective plurality of female terminals.

9. The cooking appliance of claim 8, wherein the switch is a mechanical switch.

10. The cooking appliance of claim 8, wherein the switch is a proximity switch.

11. The cooking appliance of claim 8, wherein the one of the plurality of male terminals is different in length than other ones of the plurality of male terminals so as to disengage from the switch and provide the disconnection signal to the electronic driving unit before all of the plurality of male terminals are fully removed from their respective plurality of female terminals.

12. The cooking appliance of claim 11, wherein the one of the plurality of male terminals is longer in length than other ones of the plurality of male terminals so as to disengage from the switch and provide the disconnection signal to the electronic driving unit before all of the plurality of male terminals are fully removed from their respective plurality of female terminals.

13. The cooking appliance of claim 8, wherein various ones of the plurality of male terminals vary in length so as to be removed from respective ones of the plurality of female terminals at varying times to provide the disconnection signal to the electronic driving unit before all of the plurality of male terminals are fully removed from their respective plurality of female terminals.

14. The cooking appliance of claim 13, wherein the plurality of male terminals includes at least three sets of terminals configured with distinct lengths so as to be removed from respective ones of the plurality of female terminals at three different times to provide the disconnection signal to the electronic driving unit before all of the plurality of male terminals are fully removed from their respective plurality of female terminals.

15. The cooking appliance of claim 8, wherein the plurality of male terminals includes first and second sensor terminals, first and second power terminals and a ground terminal.

16. The cooking appliance of claim 15, wherein the first and second sensor terminals are shorter in length than the first and second power terminals, and the first and second power terminals are shorter in length than the ground terminal.

17. A cooking appliance comprising:

a cooking unit including an electronic driving unit;

an induction tray including an induction heating element, wherein the induction tray is configured to be removably attached to the cooking unit; and a connector assembly interconnecting the induction tray to the cooking unit to provide power to and control the induction tray, wherein the connector assembly includes:

a female connector assembly including a plurality of female terminals, the female connector assembly being attached to one of the induction tray or the cooking unit; and a male connector assembly including a plurality of male terminals, the male connector assembly being attached to another one of the induction tray or the cooking unit, wherein the plurality of male terminals are configured to be selectively inserted into, or removed from, respective ones of the plurality of female terminals to interconnect the induction tray to a power source, the connector assembly incorporates safety means for causing the power source to be disconnected from the induction tray through the male and female connector assemblies before the plurality of male terminals are fully removed from the plurality of female terminals, at least one male terminal of the plurality of male terminals is a temperature sensor terminal electrically connected to a temperature sensor of the induction heating element, the safety means comprises the at least one male terminal being configured different in length than other ones of the plurality of male terminals such that the at least one male terminal is removed from at least one female terminal of the plurality of female terminals to provide a disconnection signal to the electronic driving unit before all of the plurality of male terminals are fully removed from their respective plurality of female terminals, and the safety means further comprises a switch acted upon by one of the plurality of male terminals to provide a disconnection signal to the electronic driving unit before all of the plurality of male terminals are fully removed from their respective plurality of female terminals.

18. The cooking appliance of claim 17, wherein various ones of the plurality of male terminals vary in length so as to be removed from respective ones of the plurality of female terminals at varying times to provide the disconnection signal to the electronic driving unit before all of the plurality of male terminals are fully removed from their respective plurality of female terminals.

19. The cooking appliance of claim 17, wherein the plurality of male terminals includes first and second sensor terminals, first and second power terminals and a ground terminal, the first and second sensor terminals are shorter in length than the first and second power terminals, and the first and second power terminals are shorter in length than the ground terminal.

20. The cooking appliance of claim 17, wherein the one of the plurality of male terminals is different in length than other ones of the plurality of male terminals so as to disengage from the switch and provide the disconnection signal to the electronic driving unit before all of the plurality of male terminals are fully removed from their respective plurality of female terminals.

* * * * *